US009597571B2

(12) United States Patent
Rockhill

(10) Patent No.: US 9,597,571 B2
(45) Date of Patent: Mar. 21, 2017

(54) UNBALANCED WEIGHTED APPARATUS WITH A HEAVY END AND A LIGHT END

(71) Applicant: HeavySwing Holding, LLC, Baltimore, MD (US)

(72) Inventor: Gerald Keith Rockhill, Fallston, MD (US)

(73) Assignee: HeavySwing Holding, LLC, Baltimore, MD (US)

( * ) Notice: Subject to any disclaimer, the term of this patent is extended or adjusted under 35 U.S.C. 154(b) by 0 days.

(21) Appl. No.: 14/491,217

(22) Filed: Sep. 19, 2014

(65) Prior Publication Data

US 2015/0005112 A1 Jan. 1, 2015

Related U.S. Application Data

(63) Continuation of application No. 13/372,220, filed on Feb. 13, 2012, now Pat. No. 8,864,608.
(Continued)

(51) Int. Cl.
*A63B 59/06* (2006.01)
*A63B 69/00* (2006.01)
(Continued)

(52) U.S. Cl.
CPC ..... *A63B 69/0002* (2013.01); *A63B 15/00* (2013.01); *A63B 60/06* (2015.10);
(Continued)

(58) Field of Classification Search
CPC . A63B 59/06; A63B 59/0014; A63B 69/0002; A63B 2102/18; A63B 2102/182;
(Continued)

(56) References Cited

U.S. PATENT DOCUMENTS 796,184 A 8/1905 Brown
814,857 A 3/1906 Maechling
(Continued)

FOREIGN PATENT DOCUMENTS

CN 2936336 Y 8/2007
JP 9220305 A 8/1997
JP 2010-178943 A 8/2010

OTHER PUBLICATIONS

Office Action issued Mar. 8, 2016 in Japanese Patent Application No. 2013-555446 (with English language translation).

*Primary Examiner* — Mark Graham
(74) *Attorney, Agent, or Firm* — Oblon, McClelland, Maier & Neustadt, L.L.P.

(57) ABSTRACT

A weighted apparatus, such as a bat, bar, stick, racket, or club, includes added weight in one end of the apparatus to create an obviously heavy end, and thereby an unbalanced apparatus. The unbalanced apparatus gives the user the ability to create a heavy load to build strength by holding the light end of the device and a light load to build speed, endurance, and flexibility by holding the heavy end of the device. When swung holding the heavy end, such an unbalanced apparatus is uniquely effective for various sports practice regimens, certain game play, general exercise, physical rehabilitation, etc., to improve the user's strength and overall conditioning levels, to build hand speed and to promote a proper swing.

21 Claims, 12 Drawing Sheets

Related U.S. Application Data

(60) Provisional application No. 61/463,674, filed on Feb. 22, 2011.

(51) Int. Cl.
*A63B 69/36* (2006.01)
*A63B 15/00* (2006.01)

(52) U.S. Cl.
CPC ..... *A63B 60/08* (2015.10); *A63B 60/10* (2015.10); *A63B 60/24* (2015.10); *A63B 69/3638* (2013.01); *A63B 59/50* (2015.10); *A63B 60/02* (2015.10); *A63B 2069/0008* (2013.01); *A63B 2102/18* (2015.10)

(58) Field of Classification Search
CPC ..... A63B 59/50–59/58; A63B 59/581; A63B 2069/0008; A63B 60/02; A63B 60/06; A63B 60/24
USPC ..... 473/457, 519, 520, 564–568; 482/108, 482/109
See application file for complete search history.

(56) References Cited

U.S. PATENT DOCUMENTS 1,603,904 A 10/1926 Cohn
1,665,195 A 4/1928 Cohn
1,696,462 A 12/1928 Victor
2,195,681 A 4/1940 Robarge
3,231,281 A 1/1966 Wallo
3,636,811 A 1/1972 Bailey
3,861,682 A 1/1975 Fujii
4,000,895 A * 1/1977 Scott, Jr. ..... A63B 59/50 473/566
4,383,387 A 5/1983 Puskar
4,461,479 A 7/1984 Mitchell
4,600,195 A 7/1986 Hunter
4,634,121 A 1/1987 Sasaki
4,664,373 A 5/1987 Hait
4,682,773 A 7/1987 Pomilia
4,746,117 A 5/1988 Noble et al.
4,768,785 A 9/1988 Patterson
4,834,370 A 5/1989 Noble et al.
5,094,453 A 3/1992 Douglas
5,536,227 A 7/1996 Polchek et al.
5,674,138 A 10/1997 Nolan
5,741,193 A 4/1998 Nolan
5,772,541 A 6/1998 Buiatti
5,865,686 A 2/1999 MacGregor
6,379,286 B1 4/2002 Scopino et al.
6,432,006 B1 8/2002 Tribble
6,609,984 B1 8/2003 Tribble
6,692,386 B2 2/2004 Brundage
6,743,127 B2 6/2004 Eggiman
6,767,299 B1 7/2004 Chang
6,949,036 B2 9/2005 Ciesar et al.
7,198,581 B1 4/2007 Black
7,235,024 B2 6/2007 Lefebvre et al.
8,827,846 B2 9/2014 Shocklee
8,864,608 B2 * 10/2014 Rockhill ..... A63B 69/3638 473/219
2004/0048696 A1 3/2004 Ciesar et al.
2005/0037847 A1 2/2005 Pickens, Jr.
2005/0143203 A1 * 6/2005 Souders ..... A63B 59/06 473/564
2005/0153800 A1 7/2005 Tolentino et al.
2008/0202317 A1 8/2008 Capotosto
2011/0301000 A1 12/2011 Pullen

* cited by examiner

UNBALANCED WEIGHTED APPARATUS WITH A HEAVY END AND A LIGHT END

CROSS REFERENCE TO RELATED APPLICATION

This application is a continuation of U.S. application Ser. No. 13/372,220, filed Feb. 13, 2012, which claims priority to U.S. Provisional Application No. 61/463,674, filed Feb. 22, 2011, the entire contents of each of which are incorporated by reference herein.

BACKGROUND

Field of the Invention

The present invention relates to devices, such as sports training equipment, including weight added in amounts and positions calculated to improve the user's strength and conditioning, while maintaining natural and proper swing mechanics.

Description of the Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly or impliedly admitted as prior art against the present invention.

Various attempts to re-position weight within conventional sports equipment or to add additional weight to such equipment have been made. However, prior to the various inventive embodiments described below, overweighting (weighting beyond the impact axis) has been believed to be undesirable.

Further, attempts have been made to use removable weights added below the hands (i.e. where the equipment is intended to be held by the user). Removable weights make the equipment "clunky" (i.e., susceptible to unwanted vibrations) and are at risk of falling off. Additionally, the necessary modifications to the equipment in order to accept certain removable weight structures are useless in the event that the equipment breaks. Further, the amount of added weight is limited due the exterior nature of the weight. Specifically, by placing weights exterior to the bat structure, the bat become more awkward and clunky, and the weight is susceptible to falling off as additional weight is added. Additionally, the ability of the bat to withstand impact is questionable.

None of the related art devices utilize enough weight in the proper location to be swung by a user to build strength and speed, while maintaining his or her natural swing motions and promoting proper swing mechanics.

SUMMARY

The present invention was developed to provide the user with an apparatus that could be swung to build strength and speed, while allowing the user to maintain his or her natural swing motion.

The apparatus is a weighted apparatus, such as a bat, bar, stick, racket, or club, that includes added weight in one end of the apparatus to create an obviously heavy end, and thereby an unbalanced apparatus. The unbalanced apparatus gives the user the ability to create a heavy load to build strength by holding the light end of the device and a light load to build speed, endurance, and flexibility by holding the heavy end of the device. When swung holding the heavy end, such an unbalanced apparatus is uniquely effective for various sports practice regimens, certain game play, general exercise, physical rehabilitation, etc., to improve the user's strength and overall conditioning levels, to build hand speed and to promote a proper swing.

One example of the weighted apparatus is a weighted bat. The weighted bat comprises a bat body including a barrel, a handle, and a tapered portion connecting the barrel to the handle. The bat also comprises a weighted knob permanently fixed to an end of the handle. At least fifty percent of a total weight of the bat is located in a half of the bat that includes the weighted knob and the handle.

Another example of the weighted apparatus is a weighted bar. The weighted bar comprises a shaft including a first end, a second end, and a center portion connecting the first end to the second end. The bar also comprises a weighted knob permanently fixed to the first end of the shaft and a non-weighted knob permanently fixed to the second end of the shaft. At least sixty percent of a total weight of the bar is located in a half of the bar that includes the weighted knob and the first end of the shaft.

Another weighted bar also comprises a shaft including a first end, a second end, and a center portion connecting the first end to the second end. The bar also comprises a weighted handle permanently fixed to the first end of the shaft and a non-weighted handle permanently fixed to the second end of the shaft. At least sixty percent of a total weight of the bar is located in a half of the bar that includes the weighted handle and the first end of the shaft.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
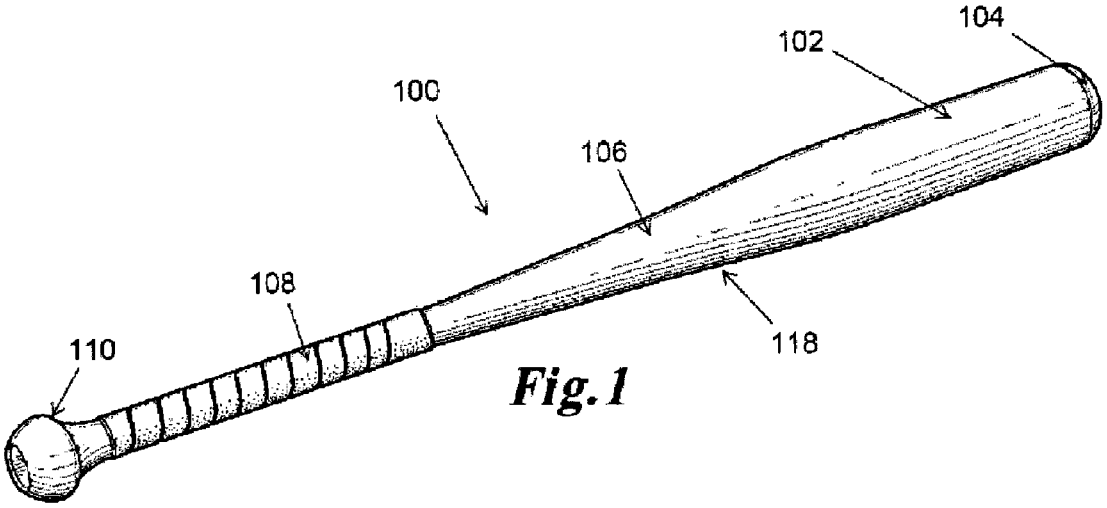
FIG. 1 is a perspective view of an embodiment of a bat.

Referring now to the drawings, wherein like reference numerals designate identical or corresponding parts throughout the several views.

Exemplary embodiments consist of a hollow piece of equipment, such as a bat, racket, club, stick, bar, pipe, etc., made from metal, plastic, carbon fiber or other like materials. A fundamental aspect of the exemplary embodiments involves including weight in one end of the piece of equipment to create an obviously heavy end, and thereby an unbalanced apparatus. The unbalanced apparatus gives the user the ability to create a heavy load to build strength by holding the light end of the device and a light load to build speed, endurance, and flexibility by holding the heavy end of the device. When swung holding the heavy end, such an unbalanced apparatus is uniquely effective for various sports practice regimens, certain game play, general exercise, physical rehabilitation, etc., to improve the user's strength and overall conditioning levels, to build hand speed and to promote a proper swing.

For example, FIG. 1 shows an exemplary embodiment of a bat, labeled as reference character 100, that includes additional weight positioned in the handle of the bat and in the knob below the handle. The opposing end of the bat does not include additional weight. Thus, the added weight being positioned in and below the handle of the bat creates additional resistance and allows a user to build strength by swinging the bat just as he or she would with a conventional bat, without disturbing or altering their natural swing mechanics. On the contrary, by overloading the user's hands with weight, and not adding weight to the barrel, swinging the bat 100 brings the users hands down naturally and drops them "inside the ball" or "into the slot," so that the user maintains their natural swing mechanics.

The bat 100 includes a bat body 118 comprising a barrel 102, a handle 108, and a tapered section 106 between the barrel 102 and handle 108. The barrel 102 has a cap 104 at the end of the barrel 102 located opposite to the tapered section 106. A tape or sleeve, often known as a grip, can be placed over the handle to make the bat easier for the user to hold. The grip can be made of leather, rubber, or another suitable material.

The barrel 102, cap 104, tapered section 106, and handle 108 can have the same dimensions (length, barrel width, handle width, etc.) as known baseball or softball bats. These dimensions are often regulated by the official rules issued by the body governing play of the league in which the bat is used. The bat 100 could have the same dimensions as baseball or softball bats that are acceptable for play in Little League, high school, college, or professional leagues. For example, a bat 100 that a little leaguer would use could be twenty-eight inches in length with a diameter at the handle 108 of 0.750 inches and a diameter at the barrel 102 of 2.250 inches. Further, a bat 100 that a major leaguer would use could be thirty-four inches in length with a diameter at the handle 108 of 0.900 inches and a diameter at the barrel 102 of 2.625 inches. However, as discussed below, the weight added to the bat 100 will likely cause the total weight of the bat 100 to exceed the maximum weight restrictions for most baseball and softball official rules.

The cap 104 located at the end of the barrel 102 can be made of plastic or other material that is conventionally used in bats. The cap 104 can be press fit, glued, or welded to the end of the barrel 102 or can be connected to the bat body 118 in a known way.

The barrel 102, tapered section 106, and handle 108 are hollow and can be made of a single piece of metal, such as aluminum or another metal or metal composite. In an alternative embodiment discussed further below, the bat body 118 can be made in multiple pieces.

A weighted knob 110 is connected at the end of the handle 108 located opposite to the tapered section 106. The weighted knob 110 is significantly heavier than a knob on a conventional baseball or softball bat. For example, the weighted knob 110 can be made of solid steel such that at least the portion of the knob that extends below the handle 108 is completely filled and does not have an air cavity therein, whereas a conventional knob is typically hollow. In alternative embodiments, the weighted knob 110 can be made of lead, steel, or other heavy metals or composite material as long as the knob 110 has the required weight discussed below. The weighted knob 110 has a section that is 0.50 to 1.50 inches in length and 0.50 to 1.00 inches in diameter and is inserted into the hollow handle 108. The portion of the knob not inserted into the handle 108 is 2.0 to 3.5 inches in length and 1.5 to 2.0 inches in diameter. Thus, the bat 100 with the knob 110 attached can range from 26.0 to 36.0 inches in length.

The weighted knob 110 preferably weighs from 7.0 to 20.0 ounces, and more preferably weighs 18.0-20.0 ounces. A conventional knob weighs approximately 2.0 to 3.0 ounces. Thus, the bat 100 with the weighted knob 110 weighs at least 5.0 to 18.0 ounces more than a conventional bat of the same length.

The knobs 110 can be totally or partially colored with different colors depending on the weight of the bat 100. Thus, the user could easily identify the weight of the bat 100 just from the color of the knob 110.

Figure 2:
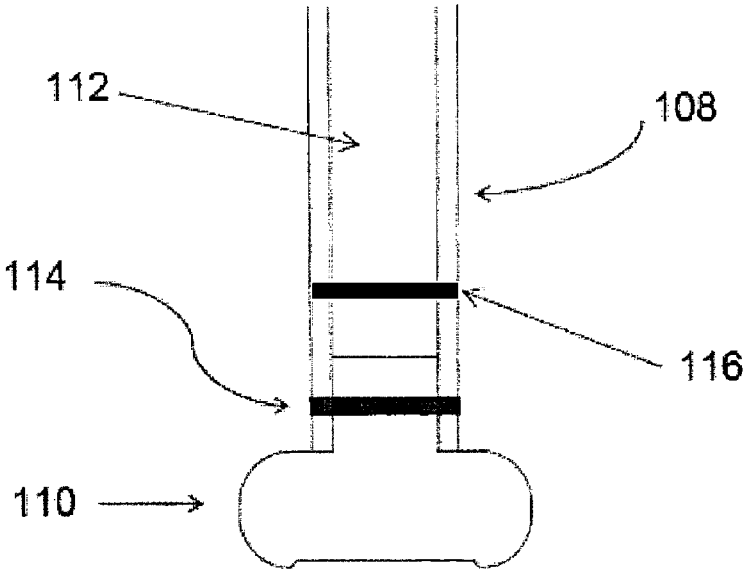
FIG. 2 is a cross-sectional view of the bat.

The bat 100 can also include a weighted rod 112 within the handle 108 that has an end that abuts or nearly abuts the knob 110, as shown in FIG. 2. The weighted rod 112 is included in the bat 100 when the desired total weight of the bat is greater than a weight that the bat with only the weighted knob 110 can provide. For example, a bat 100 that is thirty-six inches in length that includes the weighted knob 110, but no rod 112, weighs approximately 40.0 to 50.0 ounces. In order to make the bat 100 have a total weight of eighty ounces, a rod 112 weighing 30.0 to 40.0 ounces is added to the bat 100. As noted above this rod 112 is positioned within the handle 108. If a large enough rod 112 is added, it is possible that the rod could extend into the tapered section 106. This is acceptable as long as the weight distribution discussed below is maintained. Preferably, the rod 112 does not extend beyond the half-way point of the bat 100 (beyond eighteen inches in a thirty-six inch bat).

The weighted rod 112 can be a solid rod made of steel, lead, or another heavy metal or composite material to provide the desired weight. The weighted rod 112 preferably weighs from 3.0 and 60.0 ounces, and more preferably weighs 3.0 to 40.0 ounces.

Exemplary embodiments of the weighted rod 112 made of led are two inches in length for a fifty ounce bat 100, six inches in length for a sixty ounce bat 100, ten inches in length for a seventy ounce bat 100, and fourteen inches in length for an eighty ounce bat 100. Thus, in most of the above embodiments, the weighted rod 112 is positioned entirely on the heavy side of the bat. Because the majority of the rod is positioned on the heavier side of the bat 100, the bat 100 maintains the desired weight characteristics discussed below.

As discussed above, the weight added by the weighted knob 110 and rod 112 being positioned in and below the handle 108 of the bat 100 creates additional resistance beyond conventional, non-weighted bats, and allows a user to build strength by swinging the bat 100, without disturbing or altering their natural bat swing mechanics. For a baseball or softball swing, the natural bat swing mechanics include keeping the hands "inside the ball" or dropping the hands "into the slot" during the swing. No additional weight is added on the light side of the bat beyond the rod. Thus, the bat 100 prevents casting or pulling the hands outside of the natural swing plane.

The inventor has discovered that the desired weight distribution of the bat 100 allows for the user to swing the bat 100 with the proper swing mechanics discussed above. Specifically, the inventor discovered that having at least fifty percent of the weight in the half of the bat that includes the handle and knob is preferable. This means that, if the bat were divided in half by length (i.e. the bat is divided at eighteen inches for a thirty-six inch bat), then at least half of the total weight of the bat is in the half of the bat that includes the handle and knob. More preferably, at least fifty-five percent of the weight of the bat is in the half of the bat that includes the handle and knob. Even more preferably, at least fifty-seven percent of the weight of the bat is in the half of the bat that includes the handle and knob.

The weight distribution described above is substantially different than a conventional baseball bat that typically has 60-70 percent of the weight of the bat in the half of the bat that includes the barrel. The increased and redistributed weight described above allows a user to build strength by swinging the bat 100, without disturbing or altering their natural bat swing mechanics, promotes proper and natural bat swing mechanics including keeping the hands "inside the ball" or dropping the hands "into the slot" during the swing and prevents casting or pulling the hands outside of the natural swing plane.

Adding weight beyond the limits and distribution described above will result in a "barrel-weighted" device, which is prone to causing casting and forces a user to utilize an unnatural swing and associated muscles in an attempt to control the movement of the heavy barrel.

The inventor created several samples of the bat 100 described above. The following table provides the specifications of these samples.

| Sample No. | Length (in.) | Total Weight (oz.) | Handle Weight (oz.) | Barrel Weight (oz.) | Handle Weight (%) |
|---|---|---|---|---|---|
| 2840 | 28 | 38.50 | 23.40 | 15.1 | 60.8 |
| 3040 | 30 | 39.40 | 23.40 | 16.0 | 59.4 |
| 3050 | 30 | 50.02 | 34.02 | 16.0 | 68.0 |
| 3250 | 32 | 50.04 | 28.54 | 21.5 | 57.0 |
| 3260 | 32 | 60.04 | 38.54 | 21.5 | 64.2 |
| 3360 | 33 | 59.89 | 37.99 | 21.9 | 63.4 |
| 3370 | 33 | 69.89 | 47.99 | 21.9 | 68.7 |
| 3470 | 34 | 69.99 | 48.49 | 21.5 | 69.3 |
| 3480 | 34 | 79.99 | 58.49 | 21.5 | 73.1 |

In the above chart, "Handle Weight" refers to the weight in the half of the bat that includes the handle and knob. "Barrel Weight" refers to the weight in the other half of the bat that includes the barrel.

As can be seen in the above chart, each of the samples has a weight in the handle half of the bat that is at least fifty-seven percent of the total weight of the bat. For users of the appropriate age, weight and levels of strength, each of these bats was tested and found to allow the user to keep their natural bat swing mechanics.

As can be seen in FIG. 2, a portion of the weighted knob 110 is pressed into the inside of the hollow handle 108 of the bat 100. The weighted knob 110 can be attached to the handle 108 of the bat 100 via one or more bolts 114 or pins passing through holes in the handle 108 and weighted knob 110. Epoxy or another known adhesive can also be used to secure the bolts 114 or pins within the handle 108 and knob 110.

Similarly, the weighted rod 112 is pressed into the hollow handle 108 and attached to the handle 108 via one or more pins 116 passing through holes in the handle 108 and weighted rod 112. Epoxy or another known adhesive can also be used to secure the bolts 116 or pins within the handle 108 and rod 112.

In alternative embodiments, the knob could also extend into a hollow portion of the weighted rod such that one or more pins could pass through each of the barrel, knob, and rod. Or, the rod could extend into a hollow portion of the weighted knob such that one or more pins could pass through each of the barrel, knob, and rod. Additionally, the knob and/or rod could be welded to the handle or to one another. Alternatively, the knob can be screwed onto a threaded end of the handle and permanently fixed with epoxy. Alternatively, the knob can be bored and countersunk such that a bolt could extend through the knob to secure the rod to the knob. The bolt could be welded to or attached with epoxy to be permanently fixed to the bat.

The weighted knob 110 and rod 112 are permanently fixed to the rest of the bat 100. Permanently fixed means that once the bat 100 is manufactured, the weighted knob 110 and rod 112 are not adjustable or removable from the bat 100. Further, the added weight of the weighted knob 110 and rod 112 is housed within the knob and handle, and possibly part of the tapered section. In preferred embodiments, there is no additional weight attached to the knob such that the added weight does not extend below the knob 110. By permanently fixing the weighted knob 110 to the handle 108 and the rod 112 within the handle 108, the resulting bat 100 does not rattle or become loose when the user swings the bat or makes contact with balls, for example during batting practice or a game.

In an alternative embodiment, the solid weighted knob 110 can be replaced with a lighter aluminum knob so that the additional weight is added by the weighted rod 112. This allows the majority of the added weight to be in the user's hands.

The handle 108 can have a width of seven-eights of an inch. In alternative embodiments for a bat, the handle can have a width from one-half of an inch to an inch and a half.

The total weight of the bat 100 is preferably at least thirty-five ounces, and more preferably at least forty ounces. The bat 100 can weigh up to one hundred ounces or more, as long as the weight distribution is consistent with that described above.

An exemplary bat 100 can be manufactured according to the following process. (a) The bat barrel 118 is manufactured by any number of known industry processes. (b) The weighted rod 112 is inserted into the hollow handle 108 with an epoxy coating and pressed into position. (c) The weighted knob 110 is pressed into the handle 108. (d) One or more holes are drilled through the handle 108 and knob 110 and the handle 108 and the weighted rod 112. (e) Bolts or pins are pressed through the holes and secured. (f) The barrel end cap 104 is pressed into the barrel 102. (g) A grip is installed over the handle 108.

Alternatively, (a) the weighted knob 110 can first be pressed into the handle 108, followed by (b) dispensing of epoxy into the hollow handle 108, followed by (c) inserting the weighted rod into the barrel and down into the handle such that the weighted rod is pressed into and through the epoxy encapsulating it and securing it in place, followed by (d) drilling and installing the bolts or pins and the installation of the end cap 104 and grip.

In an exemplary embodiment, expandable foam can be added to the bat to surround the rod and to make the bat more solid. After the weight and knob are installed, the foam is added from the barrel end of the bat (or the non-weighted end of the bar, club, etc.). The foam hardens, encapsulates the weight and fills any remaining void/air space in the bat.

Figure 3:
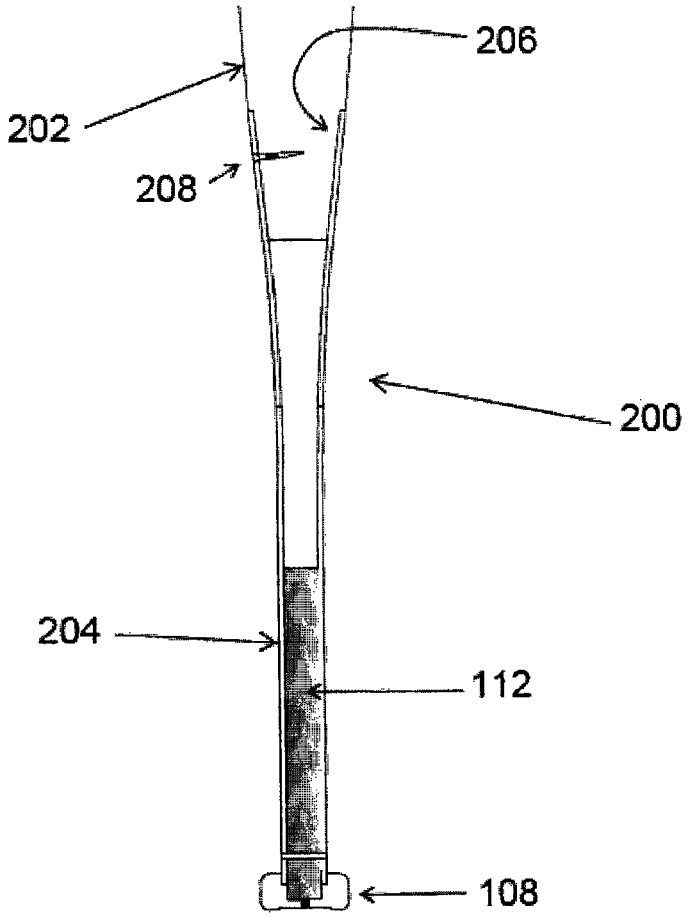
FIG. 3 is a cross-sectional view of an alternative embodiment of a bat.

FIG. 3 shows another embodiment of a bat, labeled as reference character 200. Features of the bat 200 that are the same as those of the bat 100 shown in FIGS. 1 and 2 are given the same reference characters.

As can be seen in FIG. 3, the bat 200 differs from the bat 100 in that the bat body is not a single piece made of metal. Instead, the bat body includes a bat barrel 202 that is made of wood and includes a tapered shape at one end. The bat body also includes a handle 204 that extends into a tapered sleeve 206. The tapered portion of the bat barrel 202 fits within the tapered sleeve 206. One or more screws 208 are drilled though the tapered sleeve 206 into the bat barrel 202 to secure the barrel 202 to the rest of the bat 200. Epoxy or another adhesive can also be used to secure the bat barrel 202 within the tapered sleeve 206 and the screws 208 into the bat 200. Preferably, the screws 208 extend into the bat 200 in a direction that is perpendicular to a surface of the tapered sleeve 206.

The bat handle 204 and tapered sleeve 206 can be made of a single piece of metal, for example, aluminum, or a composite material. The bat barrel 202 can be made of wood that is used for conventional wooden bats, for example, maple or ash, or other conventionally used wood. The wooden bat barrel 202 is preferable for Major League Baseball (TRADEMARK) players and other players in leagues that use wooden bats since the bat 200 allows the user to have the same feel as when hitting balls with a conventional wooden bat.

The bat 200 maintains essentially the same weight distribution as the bat 100 discussed above. Specifically, the bat includes at least half of the total weight in the half of the bat that includes the handle and knob. More preferably, at least fifty-five percent of the weight of the bat is in the half of the bat that includes the handle and knob. Even more preferably, at least fifty-seven percent of the weight of the bat is in the half of the bat that includes the handle and knob.

If a large enough rod is required, the barrel 202 can be bored at the end connected to the handle 204 such that the rod can extend into the barrel 202.

In an alternative embodiment of the bat 200, the barrel 202 includes a thread and the tapered sleeve 206 includes a groove such that the barrel 202 can be screwed into the tapered sleeve 206. Such an embodiment can include epoxy and/or screws 208 or can be attached without screws or epoxy.

Figure 4:
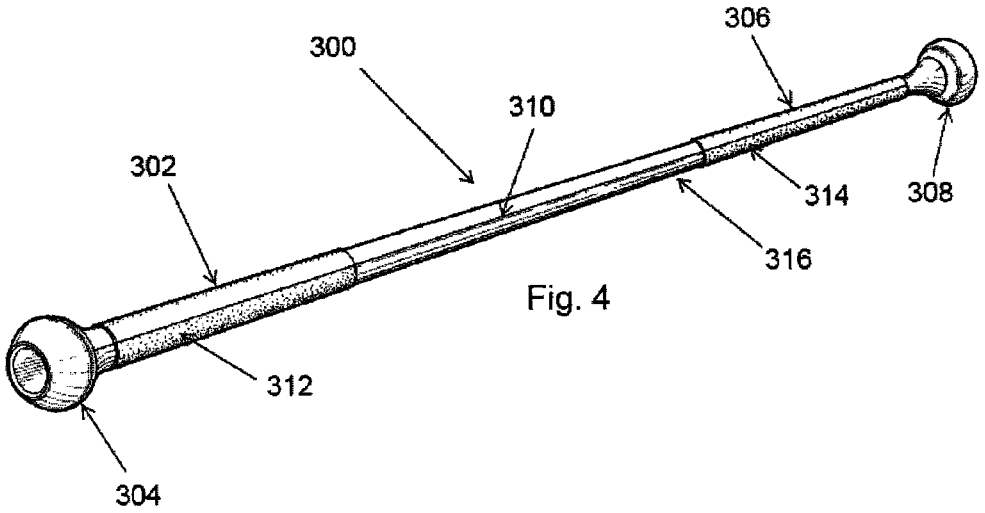
FIG. 4 is a perspective view of an embodiment of a bar for baseball or softball.
Figure 4A:
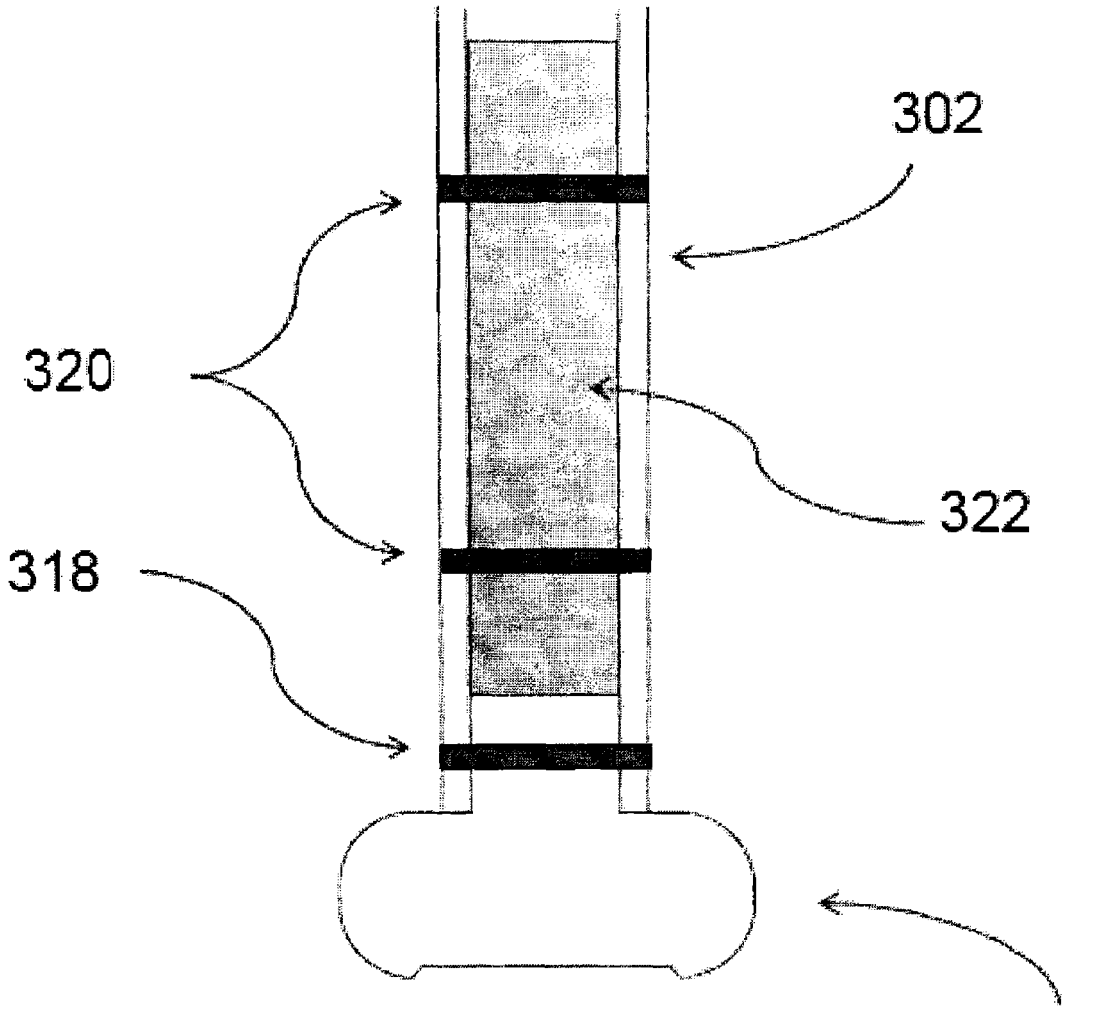
FIG. 4*a* is a cross-sectional view of the bar for baseball or softball.

FIGS. 4 and 4*a* show an alternative embodiment to the bats 100, 200 described above. Reference character 300 depicts a hollow bar 316 that includes a first handle 302 and first knob 304 at a first end and a second handle 306 and second knob 308 at a second end. A center portion 310 connects the first handle 302 to the second handle 306. The length and width of the handles 302, 306 and knobs 304, 308 can be identical or nearly identical. However, one of the knobs, such as the first knob 304, can be a weighted knob like the weighted knob 110 described above. The other knob, in this example the second knob 308, is a hollow, non-weighted knob in order to keep the weight light at the second end of the bar 300. The second knob 308 is significantly lighter than the weighted first knob 304 and can weigh, for example seven ounces. To keep the weight down, the second knob 308 could be made of aluminum, plastic, fiberglass, or another light material.

The total length of the bar 300 can range from 30.0 to 40.0 inches. The total weight of the bar 300 can range from 30.0 to 110.0 ounces.

Additionally, a weighted rod 322, similar to the weighted rod 112 described above, can be inserted in the first handle 302 to create a bar than that is heavier than a bar with just the weighted first knob 304 alone. The weighted rod 322, knob 304, and first handle 302 can be connected as discussed above for the bat 100. Depending on the size of the rod 322, it can be positioned entirely in the first handle 302 or extend into the center portion 310. For example, the length of the rod 322 can range from 2.0 to 22.0 inches. As with the bats 100, 200, the weighted first knob 304 and weighted rod 322 are permanently attached to the bar 300, for example via pins 318, 320 and epoxy, or welding. The second handle 306 does not include a weighted rod or any additional weight to keep the weight light at the second end of the bar.

Thus, the bar 300 includes a heavy side (the side with the first handle 302 and first knob 304) and a light side (the side with the second handle 306 and second knob 308). Accordingly, the bar can be swung like the bats 100, 200 described above and provide the same advantages.

For the weighted bar 300, the inventor discovered that having at least sixty percent of the weight in the half of the bar that includes the weighted knob is preferable. This means that, if the bar were divided in half by length (i.e. the bar is divided at twenty inches for a forty inch bar), then at least sixty percent of the total weight of the bar is in the half of the bar that includes the weighted knob. More preferably, at least sixty-four percent of the weight of the bar is in the half of the bar that includes the weighted knob.

The inventor created several samples of the bar 300 described above. The following table provides the specifications of these samples.

| Sample No. | Length (in.) | Total Weight (oz.) | Heavy Side Weight (oz.) | Light Side Weight (oz.) | Handle Weight (%) |
|---|---|---|---|---|---|
| 3240 | 32 | 43.39 | 27.90 | 15.50 | 64.3 |
| 3250 | 32 | 49.99 | 34.50 | 15.50 | 69.0 |
| 3460 | 34 | 60.00 | 43.95 | 16.05 | 73.3 |
| 3660 | 36 | 60.00 | 43.40 | 16.60 | 72.3 |
| 3670 | 36 | 70.00 | 53.40 | 16.60 | 76.3 |
| 3680 | 36 | 80.00 | 63.40 | 16.60 | 79.3 |
| 3690 | 36 | 90.00 | 73.40 | 16.60 | 81.6 |
| 3600 | 36 | 100.00 | 74.60 | 25.50 | 74.5 |

In the above chart, "Heavy Side Weight" refers to the weight in the half of the bar that includes the weighted handle and knob. "Light Side Weight" refers to the weight in the other half of the bar that does not include a weighted handle knob.

The first handle 302, second handle 306, and center portion 310 are shown as having a circular cross-section with a constant diameter. This diameter can be seventh-eights of an inch to give the user the feeling of holding a baseball or softball bat. Bars having other diameters, from one-half of an inch to one and a half inches are also considered, depending on the desire of the user. Additionally, a grip could be added to the handles to give the user the feel of a baseball or softball bat with a grip. The bar 300 can have a constant diameter between the knobs 304, 308. Alternatively, the center portion 310 can also taper outward to a wider diameter than the handles to provide for additional weight for the bar.

As discussed above, a user could swing the weighted bar 300 just like one of the weighted bats 100, 200. When the user holds the first handle 302, the weight is positioned generally in and below the user's hands. Thus, swinging the weighted bar 300 provides the same benefits noted above with the weighted bats 100, 200.

A user would not likely swing the weighted bar 300 while holding the second handle 306 since holding the second handle 306 places the weighted first handle 302 and knob 304 away from the user's body. Swinging the weighted bar 300 in this configuration with the added weight away from the user's hands would cause casting, thereby taking the user's swing outside of the preferred path for a standard swing. It is only recommended that the weighted bar 300 be used in this manner for stretching and non-swing exercises.

In order for a user to easily differentiate between the first handle 302 and second handle 306, and to better understand how to use the weighted bar 300, different grips are provided on the different handles. A first grip 312, having a similar length as a standard baseball or softball grip, is provided on the first handle 302 such that the user can hold the first handle with both hands on the first grip 312, as would be done with a conventional baseball or softball bat. For example, the first grip 312 can have a length of 7.0 to 11.0 inches.

A second grip 314, that is shorter than the first grip 312, is provided on the second handle 306. The second grip 314 is short enough so that the user could not hold the second handle 306 as would be done with a conventional softball or baseball bat and have both hands on the second grip 314. For example, the second grip 314 could have a length of 4.0 to 5.0 inches. This allows the user to grip the second handle 306 to perform stretches and other non-swing exercises. Each grip 312, 314 can be made of rubber, leather, or another suitable material.

In an alternative embodiment, the grip on each handle of the bar 300 is the same length. The grip on first handle 302 is entirely one color, such as black. The grip on the second handle 306 is divided into two colors, with the half of the grip on the second handle 306 that is closer to the second knob 308 being the same color as the grip on the first handle. For example, the grip could be half black and half clear. Thus, the color scheme will help the user understand that they are only supposed to swing the bar 300 while holding the first handle 302. Of course, other color schemes could be used.

Due to having handles and knobs on both ends, the weighted bar 300 would likely not be used to hit balls during practice or a game. Instead, in addition to swinging, the weighted bar 300 could also be used for stretching and additional exercises. For example, the user could first use the weighted bar 300 to perform a series of warm-up stretches followed by conditioning exercises while holding one or both handles of the weighted bar 300. The weighted bar 300 is advantageous to a user during exercise because the user can change the amount of effort required to lift or swing the bar just by changing where the bar is held.

For example, the user could perform a series of lifts of the bar 300 holding the light end of the bar. By holding the light end, the bar 300 feels heaviest since the weight of the bar is concentrated at the opposite end from where the user is holding. Once the user is exhausted, he or she can grip the bar closer to the middle or on the heavier end of the bar, thereby making the bar feel lighter and enabling the user to perform additional reps without having to change to a different piece of equipment.

After the exercises are complete, the user can hold the grip 312 of the first handle 302 of the weighted bar 300 and perform a series of swings to build power and speed, all while ensuring proper swing mechanics.

Figure 5:
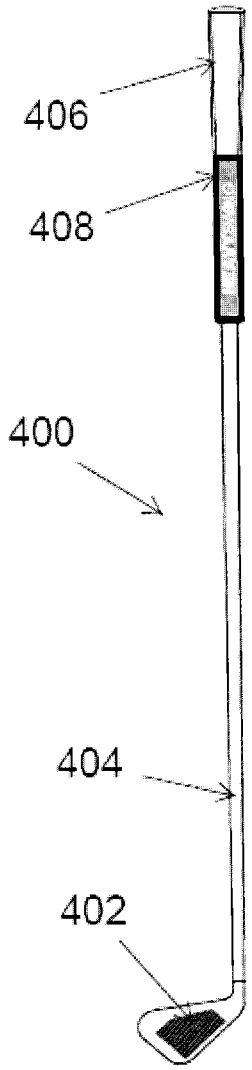
FIG. 5 is a perspective view of an embodiment of a golf club.
Figure 6:
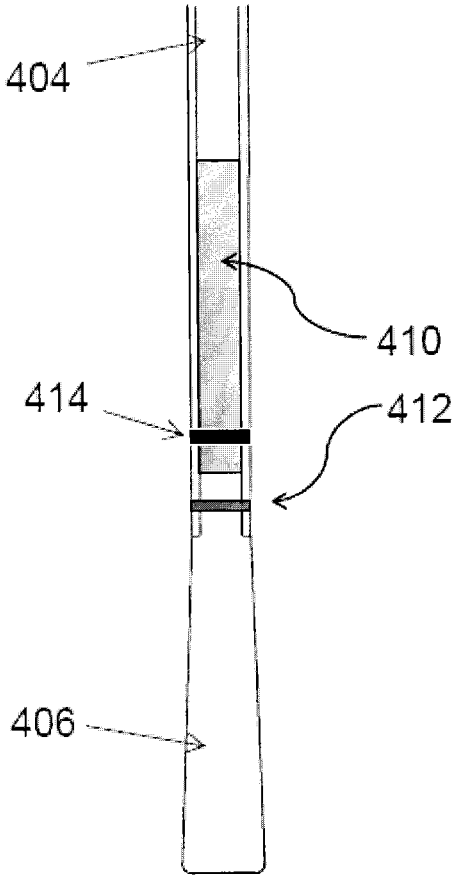
FIG. 6 is a cross-sectional view of the golf club.

Another exemplary embodiment is shown in FIGS. 5 and 6. Reference character 400 in FIGS. 5 and 6 is a weighted golf club. The golf club 400 includes a club head 402 attached to one end of a shaft 404. The club head 402 and shaft 404 can be conventional heads and shafts used for conventional golf clubs. Specifically, the club head 402 and shaft 404 can have dimensions and weights similar to those used for conventional golf clubs. The club head 402 and shaft 404 can also be made of the same or similar materials, and made and assembled by the same and similar processes as those used to make conventional golf clubs. The club head 402 and shaft 404 can have shapes similar to conventional drivers, woods, rescue clubs, wedges, irons, etc. Similar to the bats described above, the dimensions, materials, and weights of the club head 402 and shaft 404 can be dictated by the official rules issued by the body governing play of the league in which the user participates. For example, the club head 402 and shaft 404 can comply with the rules of the United States Golf Association (USGA) or Professional Golfers' Association (PGA).

Unlike conventional golf clubs, a weighted handle 406 is attached at the end of the shaft 404 that is opposite to the club head 402. The weighted handle 406 is similar to the weighted knob 110 attached to the bat 100 in that the weighted handle 406 provides weight below where the user would hold the shaft 404 of the golf club 400 (i.e. the weighted handle 406 extends towards the user when the user holds the golf club 400). The weighted handle 406 can have the same diameter as the shaft 404 or can have a larger diameter than the shaft 404 so that the user knows to grip the shaft 404 above where the weighted handle 406 is attached. The weighted handle 406 can range from 4.0 to 8.0 ounces and range in length from 2.0 to 4.0 inches and from 0.50 to 1.5 inches in diameter. This will increase the total weight of a conventional golf club, typically 13.0 to 15.0 ounces, by 25 to 50 percent and, more importantly, manipulate the overall weight distribution such that preferably at least 40.0 percent, and more preferably at least 50.0 percent, of the total club weight is in the handle end, as opposed to only 20.0 to 30.0 percent of the weight being in the handle end of a conventional golf club.

As shown in FIG. 6, a weighted rod 410 can also be located within the shaft 404 to provide additional weight where the user holds the shaft 404. The weighted rod 410 can range from 4.0 to 10.0 ounces and range in length from 5.0 to 14.0 inches and from 0.375 to 1.00 inch in diameter. Along with the weighted handle 406, this will increase the total weight of a conventional golf club, typically 13.0 to 15.0 ounces, by 50 to 140 percent and, more importantly, manipulate the overall weight distribution such that 50.0 to 70.0 percent of the total club weight is in the handle end, as opposed to only 20.0 to 30.0 percent of the weight being in the handle end of a conventional golf club.

A pin 412 or bolt can be inserted through bores in the weighted handle 406 and shaft 404 to secure the handle 406 to the shaft 404. Additionally, epoxy can be used to hold the pin in place. Similarly, a pin 414 or bolt can be inserted through bores in the weighted rod 410 and shaft 404 to secure the rod 410 to the shaft 404. Additionally, epoxy can be used to hold the pin 414 or bolt in place. Thus, both the weighted handle 406 and weighted rod 410 are permanently fixed to the golf club 400.

The golf club 400 can also include a grip 408 covering the end of the shaft 404. The grip can be a conventional grip with the end cut off to allow the weighted handle 406 to be attached to the end of the shaft. Alternatively, the grip 408 can be sized to also cover the handle 406 such that the golf club 400 has an appearance similar to that of a conventional golf club with a slightly longer and wider portion at the end of the club where the handle 406 is attached.

The additional weight added by the weighted handle 406 and weighted rod 410 allow the user to build strength and speed by swinging the golf club 400. Additionally, the location of the additional weight allows the user to swing the golf club 400 with their natural swing to keep their hands inside and avoid the casting effect caused by placing additional weight in the head or throughout the entire shaft. Thus, the additional weight in the golf club 400 is not detrimental to a user trying to learn a proper "hands behind the ball" swing.

Figure 7:
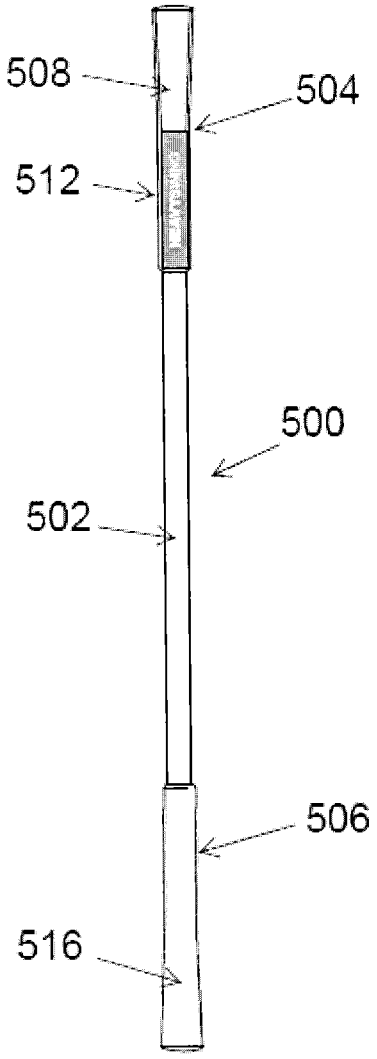
FIG. 7 is a perspective view of an alternative embodiment of a bar for golf.
Figure 7A:
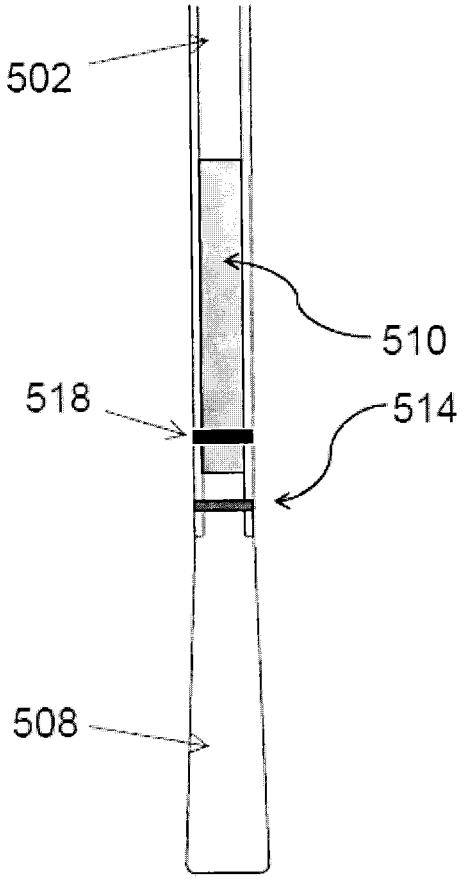
FIG. 7*a* is a cross-sectional view of the bar for golf.

FIGS. 7 and 7*a* show another exemplary embodiment of a weighted bar 500. The weighted bar 500 is similar to the weighted bar 300 described above in that the total length of the bar 500 is also from 30.0 and 40.0 inches and weighs from 30.0 to 110.0 ounces. However, each end portion, light and heavy, of the bar 500 is shaped like the end portion of the golf club 400. Thus, the end portions of the weighted bar 500 are longer and more narrow than those of the bar 300 with the bat-shaped handles.

The weighted bar 500 has a hollow shaft 502 with a weighted end 504 and a non-weighted end 506. Similarly to the golf club 400, the weighted end 504 includes a weighted handle 508 extending from the weighted end 504, a weighted rod 510 within the weighted end 504, and a grip 512. The weighted handle could preferably weigh from 12.0 and 25.0 ounces, and more preferably 25.0 ounces. The weighted handle could range from 2.0 to 8.0 inches in length and from 0.750 to 2.0 in diameter and, in a preferred exemplary embodiment, is 5.0 inches in length and 1.5 inches in diameter. The weighted rod could preferably be from 2.0 to 16.0 inches in length and 4.0 to 60.0 ounces.

For the weighted bar 500, the inventor discovered that having at least sixty percent of the weight in the half of the bar that includes the weighted knob is preferable. This means that, if the bar were divided in half by length (i.e. the bar is divided at twenty inches for a forty inch bar), then at least sixty percent of the total weight of the bar is in the half of the bar that includes the weighted handle and/or rod. More preferably, at least seventy percent of the weight of the bar 500 is in the half of the bar that includes the weighted handle, and even more preferably at least seventy-two percent of the weight is in the weighted half of the bar.

The inventor created several samples of the bar 500 described above. The following table provides the specifications of these samples.

| Sample No. | Length (in.) | Total Weight (oz.) | Heavy Side Weight (oz.) | Light Side Weight (oz.) | Handle Weight (%) |
|---|---|---|---|---|---|
| 3450 | 34 | 50.00 | 35.90 | 14.10 | 71.9 |
| 3460 | 34 | 60.00 | 45.10 | 14.90 | 75.3 |
| 3660 | 36 | 60.00 | 45.83 | 14.17 | 76.6 |
| 3670 | 36 | 70.00 | 55.40 | 14.60 | 79.0 |
| 3870 | 38 | 70.00 | 56.10 | 13.90 | 80.0 |
| 3880 | 38 | 80.00 | 65.40 | 14.60 | 82.4 |
| 3890 | 38 | 90.00 | 72.00 | 18.00 | 80.0 |
| 4000 | 40 | 100.00 | 84.70 | 15.30 | 84.7 |

A non-weighted handle 516 can be attached to the non-weighted end 506 so that the weighted bar 500 is symmetrical in dimension. However, the non-weighted handle 516 is preferably hollow or made of a light material such as aluminum, plastic or fiberglass to keep the weight low on the non-weighted end 506 of the bar.

The grip 512 can cover just the weighted end 504 of the shaft 502 or the grip 512 can cover both the weighted end 504 and weighted rod 510. The weighted handle 508 and weighted rod 510 can be attached to the weighted end 504 using pins 514, 518 that can also be held in place with epoxy. Thus, both the weighted handle 508 and weighted rod 510 are permanently fixed to the weighted bar 500.

The shaft 502 can be made of steel or aluminum or another suitable metal or alloy. Alternatively, the shaft 502 could be made of plastic or another suitable composite or material. The weighted handle 508 and weighted rod 510 can be made of lead or another suitable material.

The grip 512 is at least as long as a conventional golf grip. For example, the grip can extend approximately 7.0 to 11.0 inches from the end of the bar 500. Thus, the user can hold the weighted end 504 of the weighted bar 500 just like a conventional golf club in order to swing the weighted bar 500 with a conventional golf swing motion. The location of the weight added by the weighted handle 508 and weighted rod 510 allows the user to swing the weighted bar 500 with their natural swing plane and to avoid the casting effect caused by conventional weighted clubs and training devices.

The non-weighted end 506 is also covered with a grip 514. Similarly to the second grip 314 on the lighter handle of the weighted bar 300, the grip 514 can be smaller than the grip 512 so that the user would not fit both of his or her hands on the grip 514. For example, the grip 514 could be half of the length of the grip 511. Thus, the smaller grip 514 would indicate to the user that the bar 500 should not be swung like a golf club while holding the grip 514. Alternatively, the grip 514 could be made of different colors to indicate that the bar 500 should not be swung like a golf club while holding the grip 514.

Each of the grips 512, 514 can be made of leather, rubber, or another material that is suitable for gripping a golf club. The weighted end 504 including the first grip 512 and non-weighted end 506 including the second grip 514 each have cross sections similar to the grip-covered portion of the shaft of conventional golf clubs. For example, the weighted end 504 including the first grip 512 can have a circular cross-section with a diameter of seven-eights of an inch. The non-weighted end 506 including the second grip 514 can have the same shape and diameter. The diameters of alternative embodiments can range from one-half of an inch to an inch and a half.

The shaft can have a circular cross-section with a constant diameter of seven-eights of an inch, for example. The diameters of alternative embodiments of the shaft can range from one-half of an inch to an inch and a half. Further, the center portion of the shaft between the two grips 512, 514 can have a different diameter than the ends with the grips. The handles 508, 516 can also have a circular cross-section with a constant diameter. However, the diameter of the handles 508, 516 is bigger than the diameter of the ends where the user would hold the bar. For example, the diameter of the handles could be from five-eights of an inch to 2.0 inches. In an exemplary embodiment of the bar 500 where the diameter of both the weighted end 504 including the first grip 512 and the non-weighted end 506 including the second grip 514 is seven-eights of an inch, the handles 508, 516 have a diameter of 1.50 inches.

Figure 8:
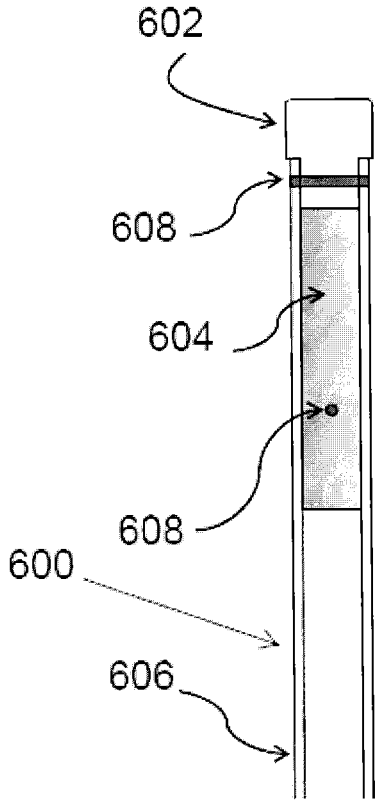
FIG. 8 is a cross-sectional view of a weighted grip portion for a stick.
Figure 8A:
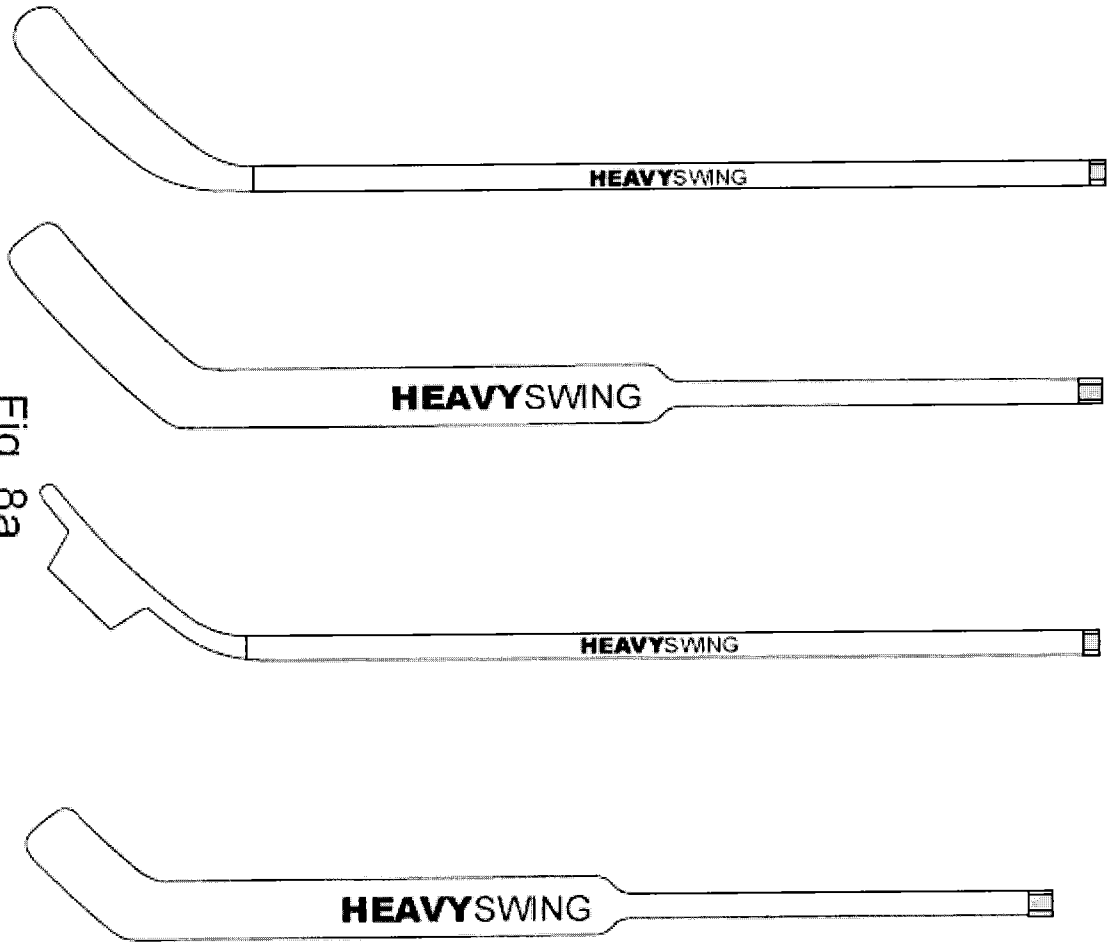
FIG. 8*a* is a view of hockey sticks with weighted grip portions.
Figure 8B:
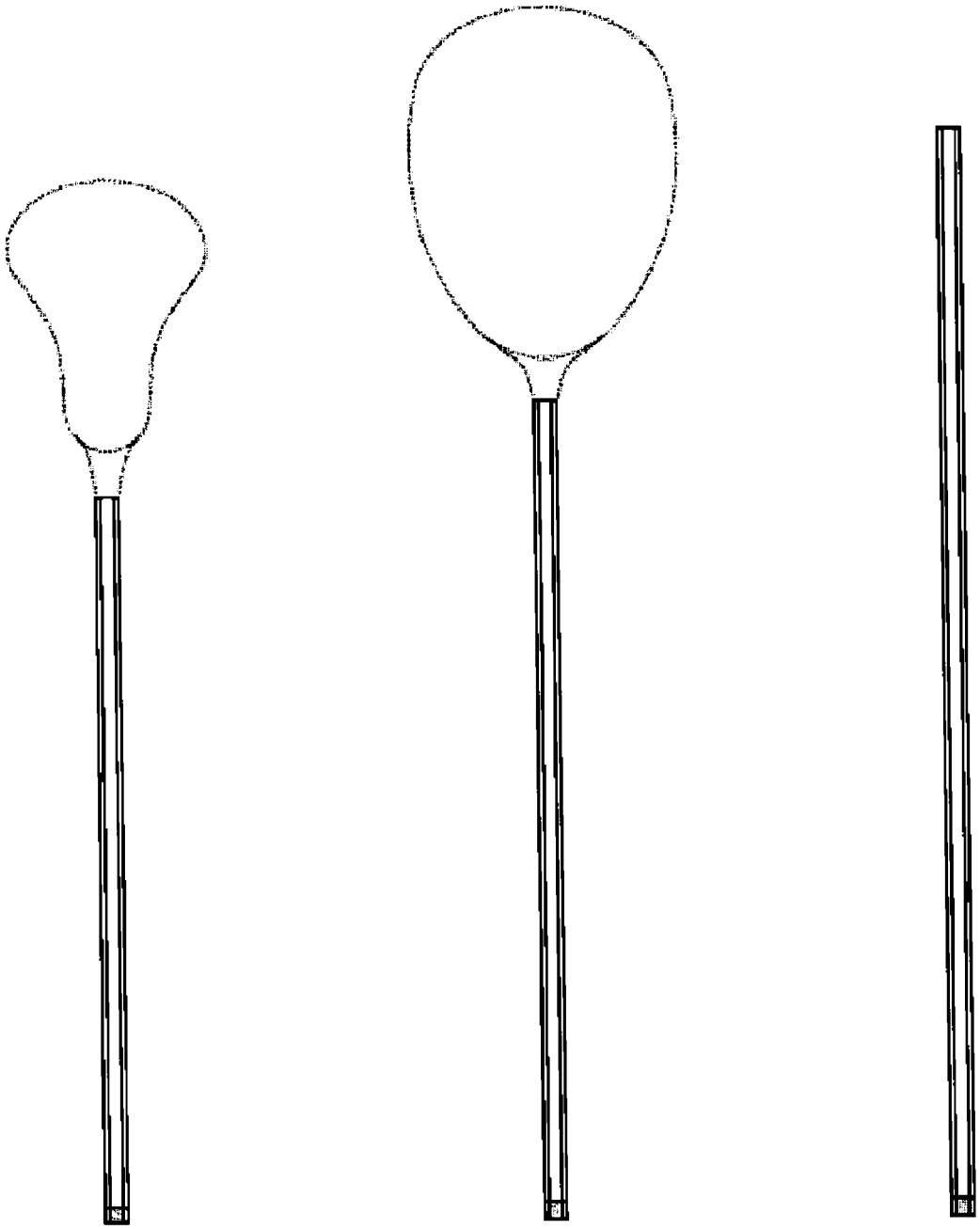
FIG. 8*b* is a view of lacrosse sticks with weighted grip portions.

The present invention includes numerous additional embodiments. For example, sticks for sports such as hockey, field hockey, lacrosse, etc., include a weighted knob and or a weighted rod permanently fixed thereto. An exemplary embodiment of a weighted knob and rod in a stick is shown in FIG. 8. The weighted stick 600 in FIG. 8 includes both a weighted knob 602 and weighted rod 604 that are permanently fixed to the handle portion 606 via pins 608. This weighted handle and rod can be applied to different types of hockey sticks, such as those shown in FIG. 8*a*, or the lacrosse sticks shown in FIG. 8*b*.

Figure 9:
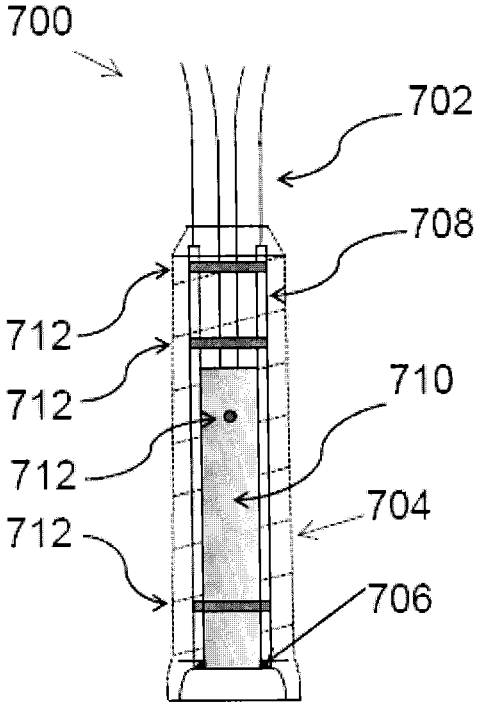
FIG. 9 is a cross-sectional view of a weighted grip portion for a racket.
Figure 9A:
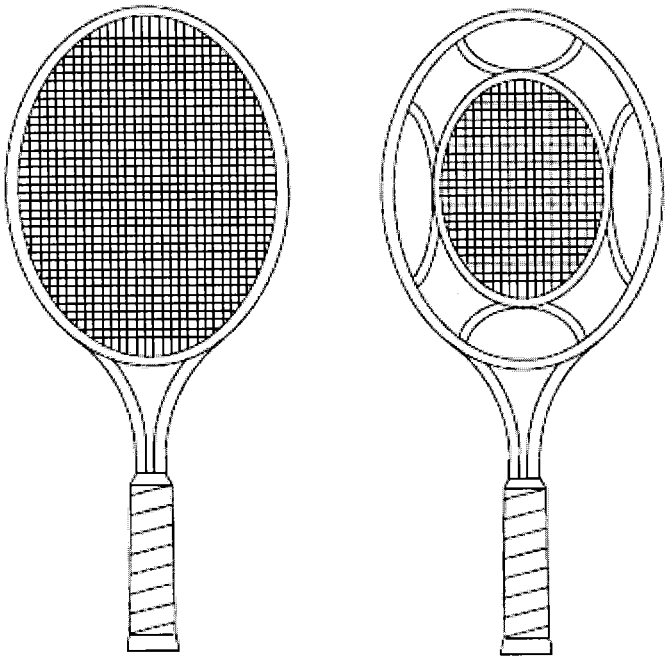
FIG. 9*a* is a view of tennis rackets with weighted grip portions.

Additionally, a racket for racket sports such as badminton, tennis, racquetball, squash, table tennis, etc., is similar to a conventional racket, but includes a weighted knob permanently fixed below the grip and/or a weighted rod permanently fixed within the grip to allow the user to build strength and conditioning, while swinging the racket with his or her natural swing. An exemplary embodiment of a weighted knob and rod in a racket is shown in FIG. 9. The weighted racket 700 in FIG. 9 includes racket tubing 702 extending from a weighted grip portion 704. A weighted sleeve 708 is attached to the racket tubing 702 via pins 712 within the grip portion 704. A weighted knob 706 and weighted rod 710 are attached to the weighted sleeve 708 via pins 712. This weighted grip configuration can be applied to different types of rackets, such as those shown in FIG. 9*a*.

An exemplary cricket bat is constructed with a metal handle having a weighted knob and optionally a weighted rod therein, with the metal handle being attached to a wooden blade of the bat similar to the bat 200 described above.

Figure 9B:
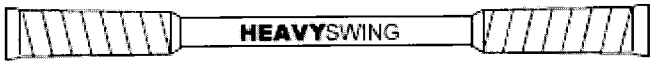
FIG. 9*b* is a view of an alternative embodiment of a bar for tennis.

Similarly to those embodiments described more fully above, each of these additional rackets, sticks, bats do not include any additional weight at the end opposite to the weighted knob, handle, and/or rod. Further, any weighted rod within the racket, stick, or bat does not extend the entire length of the racket, stick, or bat, but is instead concentrated in the end of the racket, stick, or bat that the user holds. An exemplary embodiment of a weighted racket with tennis grip portions is shown in FIG. 9*b*. For these additional embodiments, it is preferred that a minimum of 10% of the weight distribution towards the end of the device (racket, barrel, head, etc.) for a non-weighted commercial product is redistributed toward the handle by way of adding a desired and necessary amount of weight via the weighted knob, handle, and/or rod to the handle end to achieve the adjusted weight distribution and overall product weight for the particular user.

For the sports where the user's hands are not together on the racket, stick, or bat, such as hockey, the added weight is only in and around the end of the stick closer to the player (i.e. there is no additional weight lower down on the stick, for example, where a right-handed player's right hand would grip the stick for a slap shot).

Because these rackets, sticks, bats, in addition to the bats and club described above, have the components of their corresponding conventional sporting equipment, the weighted sporting equipment can be used for live play. For example, a hockey player could practice his or her slapshot with the weighted hockey stick to build strength and coordination, without adversely affecting his or her natural slapshot motion.

The inventive concept described herein can be further extended to other items, such as weighted oars or paddles for crew, rowing, kayaking, etc. Other sports equipment such as for track and field, gymnastics, or swimming is also included. Non-sports equipment that requires user movement is also included, such as drumsticks and rehabilitation equipment.

The present invention also includes weighted bars, such as the bars 300, 500 described above, that have been modified to include grip portions from the rackets, sticks, or bats described above. Such weighted bars have one grip portion on a first end with a weighted handle, knob, and/or rod permanently fixed to the first end and an identical grip portion on the second end without any additional weights (i.e. a weighted bar for tennis would have two ends that are each shaped like the grip portion of a tennis racket).

Additionally, the portion of the bar extending between the shaft can have a circular cross-section, or the cross-section can have another shape to match the shaft of the racket, stick, or bat that the grip portion is designed to be like. In the example of the bar for tennis, a bar with the grip portions of a tennis racket can have a rectangular cross-section extending between the grip portions.

Although the weighted bars described above have been indicated as being used in connection with a particular sport, alternative weighted bars could be developed for fitness and/or rehabilitation. Such bars could have grips similar to conventional barbells or rehabilitation equipment. The weighted bars would have additional weight permanently fixed to one end and no additional weight on the other end.

Obviously, numerous modifications and variations of the present disclosure are possible in light of the above teachings. For example, other materials than those described herein could be utilized. This includes, but is not limited to, using a liquid or bearings to provide the weight in the knob or rod and using screws instead of the pins or nails instead of the screws. It is therefore to be understood that within the scope of the appended claims, the invention may be practiced otherwise than as specifically described herein.

The invention claimed is:

1. A weighted bat, comprising:

a solid knob, a barrel, a handle, and a tapered portion connecting the barrel to the handle, the barrel, the handle, and the tapered portion made of a single hollow piece of metal; and a solid rod abutting the knob and extending into the tapered portion wherein the knob is permanently fixed to an end of the handle, a total weight of the bat is between 50 and 80 ounces, at least fifty percent of the total weight of the bat is located within a half of the bat that includes the knob and the handle, and the bat does not include any weight attached below the knob.

2. The weighted bat according to claim 1, wherein the rod is permanently fixed within the handle.

3. The weighted bat according to claim 1, wherein the rod is made of lead and the knob is made of stainless steel.

4. The weighted bat according to claim 1, wherein at least fifty-five percent of the total weight of the bat is located in the half of the bat that includes the knob and the handle.

5. The weighted bat according to claim 1, wherein at least fifty-seven percent of the total weight of the bat is located in the half of the bat that includes the knob and the handle.

6. The weighted bat according to claim 1, wherein a portion of the knob extends into an inside of the handle.

7. The weighted bat according to claim 1, wherein the knob weighs from 18.0 to 20.0 ounces.

8. The weighted bat according to claim 1, wherein the knob is permanently fixed to the end of the handle by pins passing through holes in the handle and the knob.

9. The weighted bat according to claim 1, wherein the rod integrally extends from the knob.

10. A weighted bat, comprising:

a solid knob, a barrel, a handle, and a tapered portion connecting the barrel to the handle, the barrel, the handle, and the tapered portion made of a single hollow piece of metal; and a solid rod abutting the knob and extending into the tapered portion;

wherein the knob is permanently fixed to an end of the handle at a first end of the knob, wherein the knob has a shape that increases in diameter or has a constant diameter continuously from the first end to a widest diameter of the knob, wherein the knob has a shape that decreases in diameter or has a constant diameter continuously from the widest diameter to a second end of the knob, the second end of the knob being opposite to the first end of the knob, wherein a total weight of the bat is between 50 and 80 ounces, wherein at least fifty percent of the total weight of the bat is located within a half of the bat that includes the knob and the handle, and wherein the bat does not include any weight attached below the second end of the knob.

11. The weighted bat according to claim 10, wherein no additional weight is provided to an exterior of the bat.

12. The weighted bat according to claim 10, wherein the knob weighs from 18.0 to 20.0 ounces.

13. The weighted bat according to claim 10, wherein the rod is permanently fixed within the handle.

14. The weighted bat according to claim 10, wherein the rod integrally extends from the knob.

15. A weighted bat, comprising:

a solid knob, a barrel, a handle, and a tapered portion connecting the barrel to the handle, the barrel, the handle, and the tapered portion made of a single hollow piece of metal; and a solid rod abutting the knob and extending into the tapered portion;

wherein the knob is permanently fixed to an end of the handle at a first end of the knob, the knob weighs from 18.0 to 20.0 ounces and a length of the knob from the first end to a second end, the second end being opposite to the first end, is 2.0 to 3.5 inches, wherein a total weight of the bat is between 50 and 80 ounces and at least fifty percent of the total weight of the bat is located within a half of the bat that includes the knob and the handle, and wherein the bat does not include any weight attached below the second end of the knob.

16. The weighted bat according to claim 15, wherein the rod is permanently fixed within the handle.

17. The weighted bat according to claim 15, wherein the rod integrally extends from the knob.

18. A weighted bat, comprising:

a knob, a barrel, a handle, and a tapered portion connecting the barrel to the handle, the barrel, the handle, and the tapered portion being a hollow, single piece of metal, the knob made of solid steel and weighing 7.0 to 20.0 ounces, the knob being permanently fixed to an end of the handle, the knob being fixed to the handle at least by epoxy to bond the knob to the handle; and a rod made of solid lead and weighing 3.0 to 60.0 ounces, the rod being permanently fixed within the handle above the knob, the rod abutting the knob and extending into the tapered portion, wherein a total weight of the bat is between 60 and 80 ounces and at least fifty percent of the total weight of the bat is located within a half of the bat that includes the knob and the handle for overloading a user's hands with weight without including any weight attached below the knob.

19. The weighted bat according to claim 18, wherein the rod integrally extends from the knob.

20. A weighted bat, comprising:

a knob, a barrel, a handle, and a tapered portion connecting the barrel to the handle, the barrel, the handle, and the tapered portion made of a single hollow piece of metal; and a solid rod abutting the knob and extending into the tapered portion;

wherein the knob is made of solid steel and is permanently fixed to an end of the handle, the knob being fixed to the handle by one or more pins passing through holes in the handle and the knob, wherein a total weight of the bat is between 60 and 80 ounces, at least fifty percent of the total weight of the bat is located within a half of the bat that includes the knob and the handle for overloading a user's hands with weight without including any weight attached below the knob.

21. The weighted bat according to claim 20, wherein the rod integrally extends from the knob.

* * * * *